US010113751B2

(12) United States Patent
Heo et al.

(10) Patent No.: US 10,113,751 B2
(45) Date of Patent: Oct. 30, 2018

(54) METHOD FOR DETERMINING WHETHER HOT WATER IS USED DURING HEATING OF AN AIR HANDLER SYSTEM

(71) Applicant: KYUNGDONG NAVIEN CO., LTD., Pyeongtaek-si, Gyeonggi-do (KR)

(72) Inventors: Chang Heoi Heo, Seoul (KR); Seung Hwan Shin, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 48 days.

(21) Appl. No.: 14/912,795

(22) PCT Filed: Jul. 22, 2014

(86) PCT No.: PCT/KR2014/006633
§ 371 (c)(1),
(2) Date: Feb. 18, 2016

(87) PCT Pub. No.: WO2015/030371
PCT Pub. Date: Mar. 5, 2015

(65) Prior Publication Data

US 2016/0209052 A1 Jul. 21, 2016

(30) Foreign Application Priority Data

Aug. 27, 2013 (KR) ..... 10-2013-0101626

(51) Int. Cl.
*F24D 19/10* (2006.01)
*F24D 3/00* (2006.01)
(Continued)

(52) U.S. Cl.
CPC ..... *F24D 19/1006* (2013.01); *F24D 3/00* (2013.01); *F24D 19/1066* (2013.01);
(Continued)

(58) Field of Classification Search
CPC ..... F24D 19/1006; F24D 19/1066; F24D 19/1084; F24H 3/00; F24H 6/00; F24H 9/2007; F24H 9/2064; F24H 3/02
(Continued)

(56) References Cited

U.S. PATENT DOCUMENTS 4,848,655 A * 7/1989 Woodin ..... F24D 3/08 236/25 R
5,544,645 A * 8/1996 Armijo ..... F24D 19/1066 126/101
(Continued)

FOREIGN PATENT DOCUMENTS

EP 0548389 A1 * 6/1993 ..... F24D 3/08
KR 10-2009-0037563 A 4/2009
(Continued)

OTHER PUBLICATIONS

"KR_20100000118_A_M—Machine Translation.pdf", Machine translation of KR Application #10-2008-0059493 Publication #10-2010-0000118, KIPO, Jun. 20, 2017.*
(Continued)

*Primary Examiner* — Gregory Huson
*Assistant Examiner* — Daniel E Namay
(74) *Attorney, Agent, or Firm* — Stein IP, LLC

(57) ABSTRACT

A method for determining whether hot water is used during heating of an air handler system which uses a water heater as a heat source and supplies hot air through a duct for heating is disclosed. The method includes: (a) detecting a flow rate change of tap water supplied to the water heater; (b) detecting a temperature change of the tap water supplied to the water heater; and (c) determining that hot water is used during heating when the flow rate change of the tap water in step (a) and the temperature change of the tap water in step (b) are detected at the same time.

1 Claim, 3 Drawing Sheets

(51) Int. Cl.

| | |
|---|---|
| ***F24H 6/00*** | (2006.01) |
| ***F24H 9/20*** | (2006.01) |
| *F24H 3/06* | (2006.01) |
| *F24H 3/12* | (2006.01) |
| *F24H 3/02* | (2006.01) |

(52) U.S. Cl.
CPC ..... *F24D 19/1084* (2013.01); *F24H 6/00* (2013.01); *F24H 9/2007* (2013.01); *F24H 9/2064* (2013.01); *F24H 3/02* (2013.01)

(58) Field of Classification Search
USPC ..... 237/8 A, 2 A, 12, 81, 16, 59; 122/14.21, 122/14.3
See application file for complete search history.

(56) References Cited

U.S. PATENT DOCUMENTS 6,129,284 A * 10/2000 Adams ..... F23N 5/203 236/21 R
2007/0257122 A1* 11/2007 Shimada ..... F23N 1/082 237/12
2008/0264490 A1* 10/2008 York ..... F24D 5/02 137/8
2010/0307733 A1* 12/2010 Karamanos ..... F24F 13/04 165/254
2014/0197243 A1* 7/2014 Cohen ..... F24H 6/00 237/50
2015/0233597 A1* 8/2015 Dempster ..... F24F 11/0012 165/11.2
2015/0369494 A1* 12/2015 Skovmose Kallesoe ..... F24D 19/1006 165/247
2016/0003486 A1* 1/2016 Minamisako ..... F24D 19/0092 122/14.1
2016/0047556 A1* 2/2016 Klier ..... F24D 19/1057 126/611
2016/0211534 A1* 7/2016 Ono ..... F24F 11/02
2016/0290674 A1* 10/2016 Tateishi ..... F24D 19/1006
2016/0320075 A1* 11/2016 Deivasigamani ... F24D 19/1066

FOREIGN PATENT DOCUMENTS

KR 10-2010-0000118 A 1/2010
KR 10-2011-0035297 A 4/2011
KR 10-2011-0121561 A 11/2011

OTHER PUBLICATIONS

"KR_20090037563_A_M—Machine Translation.pdf", Machine translation KR Application #10-2007-0102933 Publication #10-10-2009-0037563, KIPO, Jun. 20, 2017.*
"KR_20110035297_A_M—Machine Translation.pdf", Machine translation of KR Application #102009-0092943 Publication #10-2011-0035297, KIPO, Jun. 20, 2017.*
"KR_20110121561_A_M—Machine Translation.pdf", Machine translation of KR Application #10-2011-0039919 Publication #10-2011-0121561, KIPO, Jun. 20, 2017.*
International Search Report dated Sep. 24, 2014, issued to the corresponding International Application No. PCT/KR2014/006633.
International Search Report dated Jul. 22, 2014, issued by the Korean Intellectual Property Office in corresponding application PCT/KR2014/006633.

* cited by examiner

[FIG. 2]
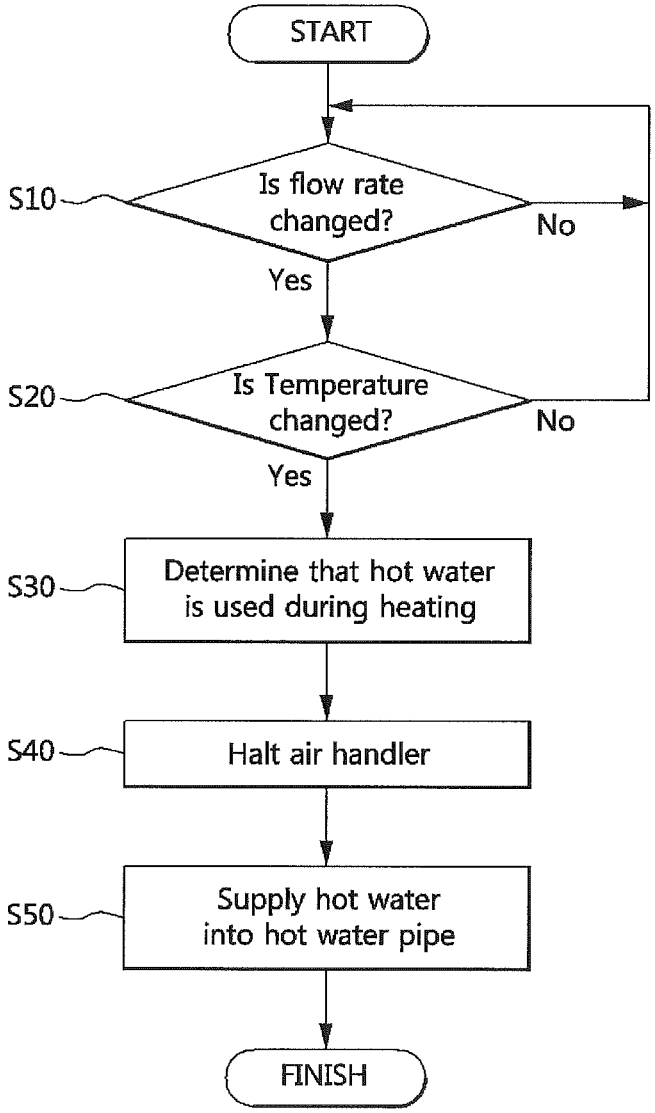

[FIG.3]
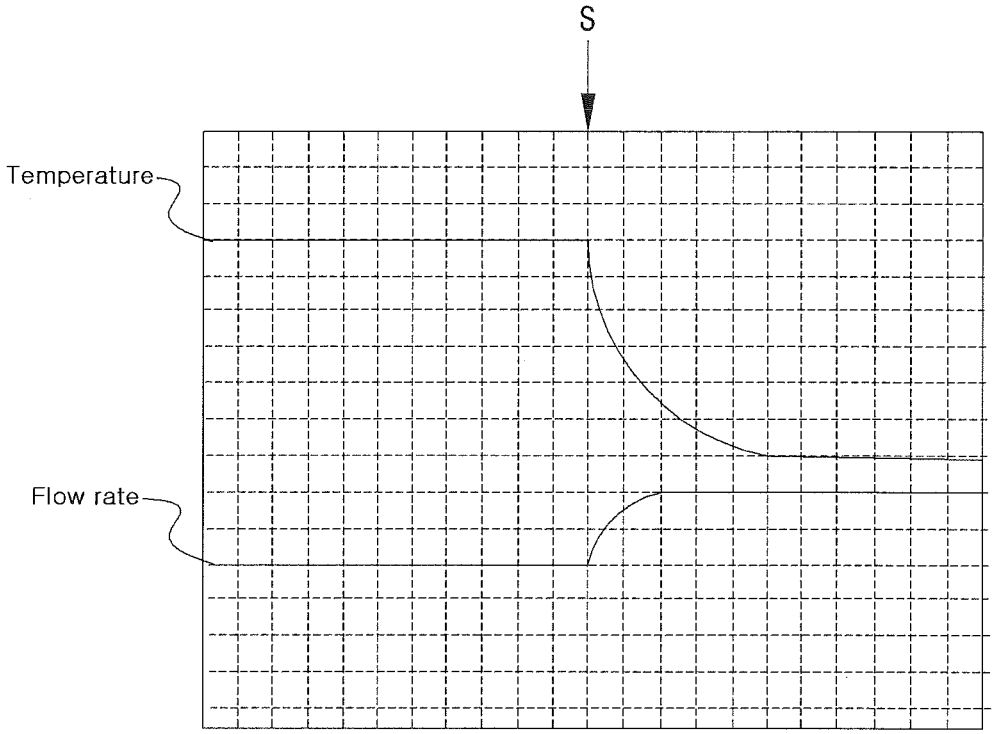

METHOD FOR DETERMINING WHETHER HOT WATER IS USED DURING HEATING OF AN AIR HANDLER SYSTEM

CROSS-REFERENCE TO RELATED APPLICATIONS

This application is a national stage of International Application No. PCT/KR2014/006633, filed Jul. 22, 2014, which claims the benefit of priority to Korean Application No. 10-2013-0101626, filed Aug. 17, 2013, in the Korean Intellectual Property Office, the disclosures of which are incorporated herein by reference.

TECHNICAL FIELD

The present invention relates to a method for determining whether hot water is used during heating of an air handler system, and more particularly, to a method for determining whether hot water is used during heating of an air handler system using a water heater as a heat source so as to appropriately control each of a hot water temperature and a heating temperature.

BACKGROUND ART

Generally, an air handler is a device that heats air by exchanging heat between a heat medium provided from a heat source and outside air at an air conditioner, thereby supplying the heated air into an internal space for heating. When cooling the internal space, on the other hand, the device cools air by exchanging heat between a cooled heat medium and outside air, and supplies the cooled air into the internal space.

While various heat sources can be used as a heat source for an air handler during heating, an air handler system utilizing a water heater as a heat source is proposed. In the Korean Laid-Open Patent Publication No. 10-2011-0121561 (Method for Improving Performance of Heating and Cooling System and Heating and Cooling System Using The Method, Publication date: Nov. 7, 2011), a system, which circulates and receives heated water from a water heater, and heats air by drawing air through a blower to supply the heated air into an internal space, is described.

Although the patent was for improving the performance of the air handler system by controlling a discharge rate of air, some conditions when using a water heater as a heat source were not considered.

For example, when hot water is heated by a water heater to heat air, and the hot water is used while the hot water is used in heating, there is a problem in that a hot water temperature and a heating temperature could not reach a set temperature. In particular, when the hot water temperature cannot reach the set temperature while using the hot water, a user can immediately feel this and may dissatisfy the performance of the product.

SUMMARY OF INVENTION

Technical Problem

The present invention is directed to providing a method for determining whether hot water is used during heating of an air handler system capable of accurately detecting whether the hot water is used during the heating using the air handler system.

Here, the present invention is also directed to providing a method for determining whether hot water is used during heating of an air handler system capable of accurately detecting whether the hot water is used without any increase in production cost such as an installation of a separate flow sensor or the like.

In addition, the present invention is also directed to providing a method for determining whether hot water is used during heating of an air handler system capable of supplying the hot water at a set temperature by halting the heating and supplying the hot water when it is detected that the hot water is used during the heating using the air handler system.

Solution to Problem

One aspect of the present invention provides a method for determining whether hot water is used during heating of an air handler system which uses a water heater as a heat source and supplies hot air through a duct for heating, including (a) detecting a flow rate change of tap water supplied to the water heater, (b) detecting a temperature change of the tap water supplied to the water heater, and (c) determining that the hot water is used during heating when the flow rate change of the tap water in operation (a) and the temperature change of the tap water in operation (b) are detected at the same time.

Advantageous Effects of Invention

The method for determining whether hot water is used during heating of an air handler system of the present invention can detect whether the hot water is used during the heating while using the handler system as it is which uses a conventional water heater as a heat source without additional flow sensor or the like, thereby causing no increase in costs, and is capable of discontinuing heating and supplying hot water at a set temperature when the hot water is used during the heating, thereby preventing a user from feeling dissatisfaction with the product.

BRIEF DESCRIPTION OF DRAWINGS

FIG. 2 is a flowchart illustrating a method for determining whether hot water is used during heating of the air handler system according to an exemplary embodiment of the present invention; and FIG. 3 is a graph illustrating changes in flow rate and temperature of tap water as a standard for determining whether the hot water is used during the heating.

REFERENCE SIGNS LIST

Figure 1:
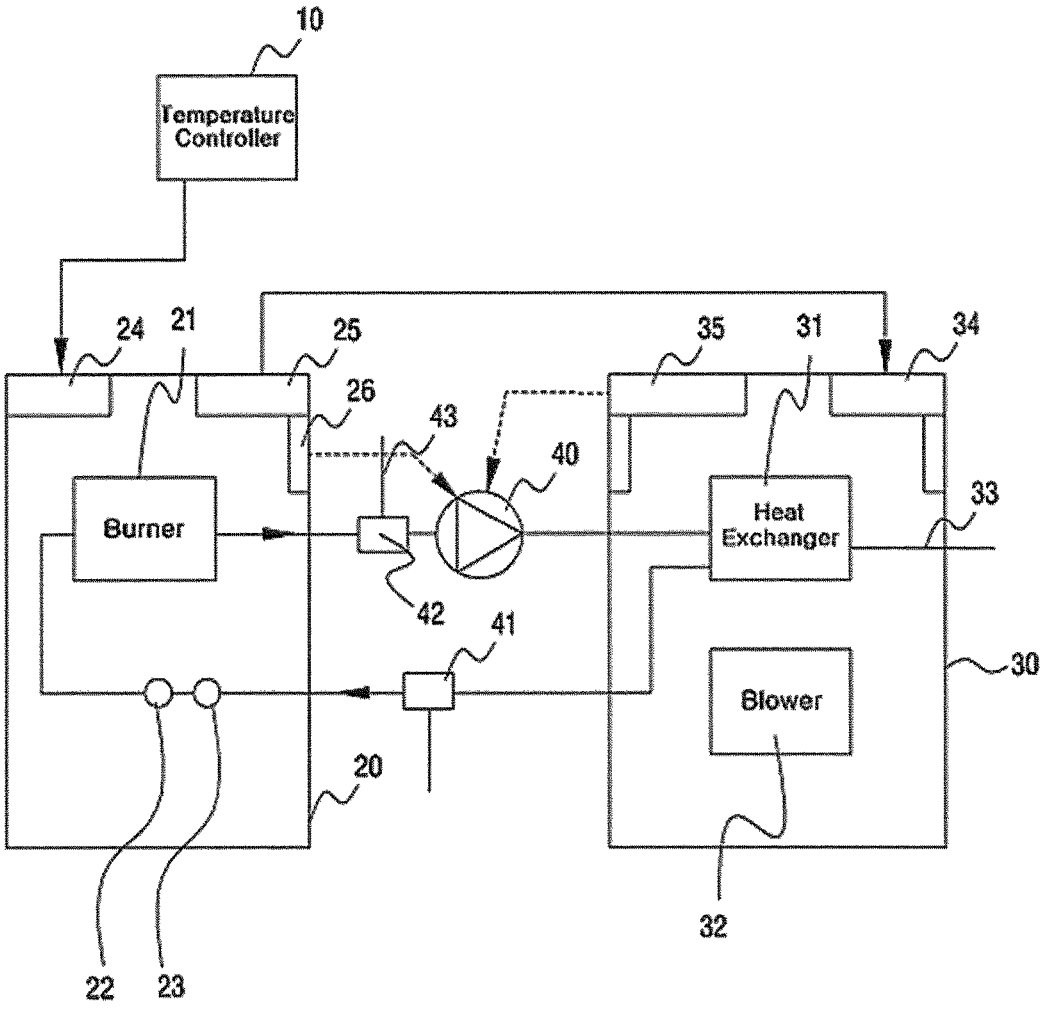
FIG. 1 is a block diagram illustrating an air handler system to which the present invention is applied.

10: temperature controller
20: water heater
21: burner
22: temperature sensor
23: flow sensor
24, 34: thermostat input
25: thermostat output
26, 35: pump controller
30: air handler
31: heat exchanger
32: blower
33: duct

40: pump
41, 42: three-way valve
43: hot water pipe

DESCRIPTION OF EMBODIMENTS

Hereinafter, a method for determining whether hot water is used during heating of an air handler system according to the present invention will be described with reference to the accompanying drawings.

FIG. 1 is a block diagram illustrating an air handler system to which the present invention is applied, and FIG. 2 is a flowchart illustrating a method for determining whether hot water is used during heating of the air handler system according to an exemplary embodiment of the present invention.

Referring to FIGS. 1 and 2, the method for determining whether hot water is used during heating of the air handler system to which the present invention is applied includes determining (S10) a change in a detected result of a flow rate from a flow sensor 23 of a water heater 20, when the flow rate changes, determining (S20) whether a temperature is lowered in a detection result of a temperature sensor 22 which detects a temperature of tap water flowing into a burner 21 of the water heater 20, when it is determined that the temperature of the tap water is lowered in operation S20, determining (S30) that the hot water is used during the heating, when it is determined that the hot water is used, halting (S40) an operation of an air handler 30 and supplying (S50) hot water at a set temperature by controlling a hot water supply from the water heater 20.

Hereinafter, a configuration and operations of the method for determining whether hot water is used during heating of the air handler system according to the exemplary embodiments of the present invention will be described in detail.

First, referring to a configuration of the air handler system to which the present invention is applied, the air handler system includes a temperature controller 10, a water heater 20 which is a heat source heating tap water to supply hot water, and an air handler 30 which heat-exchanges air provided from a blower 32 in a heat exchanger 31 where the hot water is circulated and supplied from the water heater 20 through a pump 40, and supplies the heat-exchanged air through a duct 33.

The water heater 20 includes a burner 21, and a temperature sensor 22 and a flow sensor 23 which respectively detect temperature and flow rate of the tap water supplied into the burner 21.

The tap water is tap water (hereinafter referred to as "supply tap water") which is directly supplied from a water pipe through a three-way valve 41 or water (hereinafter referred to as "circulating water") which is circulated in the heat exchanger 31 of the air handler 30. A three-way valve 42 is provided at the front end of the pump 40 to such that it can supply water heated in the burner 21 into the heat exchanger 31 or a hot water pipe 43.

In the configuration described above, during the heating operation, a thermostat input 24 which receives a set temperature from a temperature controller 10 causes the burner 21 of the water heater 20 to operate until the set temperature is reached, and the water heater 20 supplies the tap water to the burner 21. Then, the heated water that is circulating water is circulated and is then supplied to the heat exchanger 31 through the pump 40 and the three-way valve 42, and the circulating water, whose temperature is decreased due to heat exchange in the heat exchanger 31, is circulated in the water heater 20, thereby allowing the heating operation to be performed.

Here, the air handler 30 supplies air through the blower 32, the air supplied from the blower 32 is heat-exchanged at the heat exchanger 31 such that the temperature of the air rises up to a heating capable state. The set temperature of the temperature controller 10 is also input to the thermostat input 34 of the air handler 30 to control an operation of the pump 40 according to a heating temperature.

During the heating operation, it is determined whether there is any change in the flow rate detected by the flow sensor 23, in accordance with operation S10. When hot water is used during the heating operation, the flow rate of the circulating water, which is detected by the flow sensor 23 of the water heater 20, is increased and the temperature of the circulating water, which is detected by the temperature sensor 22, is decreased because the supply tap water supplied from the water pipe is mixed with the circulating water. By detecting the above changes, it is possible to determine that hot water is used during the heating operation.

Then, in operation S20, when there is a change in the flow rate of the circulating water as a result of the determination in accordance with operation S10, the temperature sensor 22 determines whether the temperature of the circulating water is decreased because in addition to the circulating water circulated in the heat exchanger 31, the supply tap water is supplied directly from the water pipe to the burner 21 due to the increase in the flow rate.

Then, in operation S30, when the temperature of the circulating water is decreased as a result of the determination in accordance with operation S20, it is determined that the hot water is used during the heating operation. In other words, if the flow rate of the circulating water is increased, while the temperature thereof is decreased, it is determined that hot water is used.

Then, in operation S40, the operation of the air handler 30 is halted, and in operation S50, the hot water from the water heater 20 is supplied into the hot water pipe 43 through the three-way valve 42 so that a user can use the hot water at the set temperature.

FIG. 3 is a graph illustrating changes in flow rate and temperature of tap water as a standard of determining whether the hot water is used during the heating, with an X axis representing time and a Y axis representing temperature and flow rate, but specific units and values are omitted.

Therefore, a point when the hot water is used during the heating S is determined when the flow rate of the tap water changes and the temperature decreases according to a change of time.

The above determination is mainly performed by a controller provided on the water heater 20 or a separate controller which performs the determination and control. By the determination whether the hot water is used during the heating at the water heater 20, the system may interwork with the air handler 30 independent of the type of the air handler 30, and thus a configuration thereof may be easily formed.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

INDUSTRIAL APPLICABILITY

The present invention is industrially applicable for correctly determining whether hot water is used during heating.

What is claimed is:

1. A method for determining whether hot water is used during a heating operation performed by an air handler system, wherein the air handler system comprises:

a water heater including a burner configured to heat tap water, a temperature sensor configured to measure the temperature of water flowing inside a channel through which the tap water flows into the burner, and a flow sensor configured to measure the flow rate of the water flowing inside the channel through which the tap water flows into the burner; and an air handler including a heat exchanger to which water heated by the burner is supplied, a blower configured to supply air to the heat exchanger, and a duct configured to supply warm air generated through heat exchange between the hot water and the air supplied to the heat exchanger, and wherein the method comprises:

a) by a controller, inducing heat exchange between the hot water supplied from the burner and the air supplied from the blower in the heat exchanger of the air handler, and causing circulating water whose temperature has been decreased due to the heat exchange to be circulated in the water heater, thereby performing a heating operation;

b) by the controller, determining whether the temperature of the circulating water is decreased due to the circulating water's being mixed with supply tap water supplied from a water pipe after hot water is used, by measuring the temperature of the water flowing inside a channel through which the tap water flows into the burner using the temperature sensor;

c) by the controller, determining whether the flow rate of the circulating water is increased due to the circulating water's being mixed with the supply tap water supplied from the water pipe after hot water is used, by measuring the flow rate of the water flowing inside the channel through which the tap water flows into the burner using the flow sensor; and d) by the controller, determining that the hot water is used during the heating operation if it is determined in operation (b) that the temperature of the water is decreased and it is determined in operation (c) that the flow rate of the water is increased, and then stopping the heating operation by stopping the operation of the air handler, while causing the water heated at a set temperature by the burner to be supplied through a hot water pipe.

* * * * *